US010787236B1

(12) United States Patent
Erickson et al.

(10) Patent No.: US 10,787,236 B1
(45) Date of Patent: Sep. 29, 2020

(54) TILLER TILT LOCK AND AUTOMATIC RELEASE SYSTEM

(71) Applicant: Brunswick Corporation, Mettawa, IL (US)

(72) Inventors: James E. Erickson, Fond du Lac, WI (US); Jolayne K. Ingebritson, Fond du Lac, WI (US); Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 97 days.

(21) Appl. No.: 16/257,380

(22) Filed: Jan. 25, 2019

Related U.S. Application Data

(60) Provisional application No. 62/625,130, filed on Feb. 1, 2018.

(51) Int. Cl.
*B63H 20/12* (2006.01)
*B63H 21/21* (2006.01)
*B63H 20/00* (2006.01)

(52) U.S. Cl.
CPC ..... *B63H 20/12* (2013.01); *B63H 21/213* (2013.01); *B63H 21/265* (2013.01)

(58) Field of Classification Search
CPC ..... B63H 20/00; B63H 20/007; B63H 20/08; B63H 20/10; B63H 20/12; B63H 20/14; B63H 21/21; B63H 21/213; B63H 21/26; B63H 21/265; B63H 2025/024
See application file for complete search history.

(56) References Cited

U.S. PATENT DOCUMENTS

| | | | |
|---|---|---|---|
| 3,636,911 | A | 1/1972 | Piazza et al. |
| 3,922,996 | A | 12/1975 | Meyer |
| D276,811 | S | 12/1984 | Wolfe |
| 4,496,326 | A | 1/1985 | Boda |
| 4,521,201 | A | 6/1985 | Wantanabe |
| 4,582,493 | A | 4/1986 | Toyohara |
| 4,650,429 | A | 3/1987 | Boda |
| 4,701,141 | A | 10/1987 | Sumigawa |
| D295,867 | S | 5/1988 | Walsh |
| 4,878,468 | A | 11/1989 | Boda et al. |
| 5,145,427 | A | 9/1992 | Kawai |

(Continued)

OTHER PUBLICATIONS

Honda Marine Set-Up Instructions, Long Tiller Handle, BF060A-BFP60A, Honda Motor Co., Ltd. printed May 2009, #87997-ZZ3-A00.

*Primary Examiner* — Ajay Vasudeva
(74) *Attorney, Agent, or Firm* — Andrus Intellectual Property Law, LLP

(57) ABSTRACT

A tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system such that the tiller arm is freely rotatable downwardly through the plurality of lock positions.

20 Claims, 13 Drawing Sheets

(56) References Cited

U.S. PATENT DOCUMENTS

| | | | | |
|---|---|---|---|---|
| 5,340,342 | A | 8/1994 | Boda et al. | |
| 5,545,064 | A | 8/1996 | Tsunekawa et al. | |
| 5,632,657 | A | 5/1997 | Henderson | |
| D380,478 | S | 7/1997 | Robbins | |
| 6,010,563 | A | 2/2000 | Risk, Jr. | |
| 6,020,563 | A | 2/2000 | Risk et al. | |
| 6,093,066 | A | 7/2000 | Isogawa et al. | |
| 6,146,221 | A | 11/2000 | Natsume | |
| 6,264,516 | B1 | 7/2001 | McEathron et al. | |
| 6,336,835 | B1 | 1/2002 | Naganuma | |
| 6,352,456 | B1 | 3/2002 | Jaszewski et al. | |
| 6,352,457 | B1 | 3/2002 | Higby et al. | |
| 6,406,342 | B1 | 6/2002 | Walczak et al. | |
| 6,902,450 | B2 | 6/2005 | Ohtsuki et al. | |
| 7,090,551 | B1 | 8/2006 | Lokken et al. | |
| D527,737 | S | 9/2006 | Iekura | |
| 7,160,160 | B2 | 1/2007 | Kojima | |
| 7,214,113 | B2 | 5/2007 | Kojima | |
| D552,129 | S | 10/2007 | Steinberg | |
| 7,404,747 | B2 * | 7/2008 | Shinde | B63H 20/106 440/63 |
| 7,442,104 | B2 | 10/2008 | Okabe | |
| 7,455,558 | B2 | 11/2008 | Yander | |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| 7,976,354 | B2 | 7/2011 | Kubota et al. | |
| D655,308 | S | 3/2012 | Steinberg | |
| 8,257,122 | B1 | 9/2012 | Holley | |
| 9,422,045 | B2 | 8/2016 | Kinpara et al. | |
| 9,764,813 | B1 | 9/2017 | Zarembka et al. | |
| 9,776,698 | B2 | 10/2017 | Miyatake et al. | |
| 9,783,278 | B1 | 10/2017 | Dannenberg et al. | |
| 9,789,945 | B1 | 10/2017 | Vaninetti et al. | |
| 9,896,176 | B2 | 2/2018 | Suzuki et al. | |
| 10,246,173 | B1 * | 4/2019 | Ingebritson | B63H 20/12 |
| 2001/0046819 | A1 | 11/2001 | Kawai et al. | |
| 2004/0137806 | A1 | 7/2004 | Ohtsuki | |

* cited by examiner

TILLER TILT LOCK AND AUTOMATIC RELEASE SYSTEM

CROSS-REFERENCE TO RELATED APPLICATION

The present application claims priority to and the benefit of U.S. Provisional Application Ser. No. 62/625,130, Filed Feb. 1, 2018, which is hereby incorporated by reference herein in its entirety.

FIELD

The present disclosure generally relates to tillers for steering marine vessels, and more particularly to systems and methods for tilting and automatically releasing a tiller arm for steering marine vessels.

BACKGROUND

The Background and Summary are provided to introduce a foundation and selection of concepts that are further described below in the Detailed Description. The Background and Summary are not intended to identify key or essential features of the potentially claimed subject matter, nor are they intended to be used as an aid in limiting the scope of the potentially claimed subject matter.

The following U.S. Patents are incorporated herein by reference:

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. A mount interposed between the propulsion unit and the tiller mounts the tiller for movement relative to the propulsion unit. A cable connects the tiller to the steering vane so that movement of the tiller with respect to the propulsion unit rotates the vane. The mount includes mutually engageable elements that can lock the tiller against movement relative to the propulsion unit so that the tiller may be used to directly steer the propulsion unit, if desired. For this purpose, the elements of the mount may be engaged by applying a downward pressure on the tiller.

U.S. Pat. No. 5,340,342 discloses a tiller handle for use with one or more push-pull cables innerconnected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 5,632,657 discloses a movable handle mounted to a trolling motorhead. The handle is pivotally adjustable upwardly and downwardly to suit different positions of a fisherman while controlling the trolling motor. The handle spans across the motorhead and acts as a tiller for pivoting the motor about its axis. The resistance to positional changes is adjustable and protective features are provided to prevent damage to the adjustment mechanism in the event of tightening. The handle incorporates therein various controls for the motorhead.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the throttle mechanism. This allows the operator to manipulate the throttle setting without having to change the gear setting from neutral position.

U.S. Pat. No. 7,090,551 discloses a tiller arm with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 9,422,045 discloses an operating device of an electric outboard motor having a steering bar-shaped handle projecting forward and pivotally supported on a hull to be able to steer right and left. A propeller of the electric outboard motor is driven by an electric motor driven by power supplied from a power supply. On a tip portion of the steering bar-shaped handle, the operating device is provided with an accelerator grip that is made to pivot on an axial center normally and reversely from a neutral position to adjust an amount of power to be supplied to the electric motor according to a pivot amount. The operating device includes in the accelerator grip or in vicinity of the accelerator grip, an accelerator grip fixing mechanism that fixes a pivot position of the accelerator grip at the neutral position to be able to release a fixation easily.

Additional information relating to tiller systems for steering outboard motors is also provided in U.S. Pat. Nos. 6,093,066, 6,406,342, 6,902,450, 7,214,113, 7,455,558, 7,677,938, and 7,704,110.

SUMMARY

One embodiment of the present disclosure generally relates to a tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system such that the tiller arm is freely rotatable downwardly through the plurality of lock positions.

Another embodiment generally relates to a tiller system for steering an outboard motor. The tiller system has a tiller arm that is rotatably coupled to the outboard motor. A first lock portion and a second lock portion are operatively coupled between the tiller arm and the outboard motor and are selectively engageable to prevent the tiller arm from rotating downwardly. The first lock portion has a plurality of teeth and rotates with the tiller arm, where the plurality of teeth define a plurality of index positions each configured to receive the second lock portion to prevent downward rotation of the tiller arm therefrom. The second lock portion has an activated position and a deactivated position and the second lock portion is engageable with the first lock portion only when the second lock portion is in the activated position. An unlock member is coupled to the first lock portion and configured to move the second lock portion from the activated position to the deactivated position by rotating the tiller arm. The tiller system further has a lock controller cam having an activated index and a deactivated index. A bias device biases the second lock portion into engagement with the lock controller cam. The activated index and the deactivated index correspond to the second lock portion being in the activated position and the deactivated position, respectively, and the unlock member overcomes the bias device to move the second lock portion from the activated index to the deactivated index. A tilt lock shaft rotates with the second lock member and the second lock portion is also moveable to the deactivated position by manual rotation of the tilt lock shaft in an unlock direction.

Various other features, objects and advantages of the disclosure will be made apparent from the following description taken together with the drawings.

BRIEF DESCRIPTION OF THE DRAWINGS

The drawings illustrate examples of carrying out the disclosure. The same numbers are used throughout the drawings to reference like features and like components. In the drawings.

DETAILED DISCLOSURE

Tiller systems are known devices for steering marine vessels. Within the context of tiller-based steering, it is often desirable for the operator to be able to tilt the tiller, and specifically the tiller arm, with respect to the rudder or outboard propulsion device being steered, depending on the use and conditions of operation. Some tiller systems known in the art allow the operator to lock the tiller arm in certain positions, such as in a full-up or trailer position, and sometimes a mid-point position somewhere between the up and down positions. One such tiller system includes a ratcheting tilt lock device, such as used in the Mercury 15/20EFI outboard propulsion device. Other embodiments incorporate cross-pin locks that engage with the chassis.

Through experimentation and development, the present inventors have identified issues with releasing the tiller from a locked position using systems presently known in the art. Specifically, unlocking the tiller requires the operator to reach back towards the propulsion device to manipulate a tilt lock knob or lever. This is inconvenient, particularly with marine vessels having the operator positioned farther forward or where the tiller is relatively long.

The present inventors have further identified that the Mercury 15/20EFI system has no mechanism for permanently deactivating a tilt lock system. Therefore, when a tiller arm is raised, it will automatically lock as it reaches a locking position. Additional detail regarding these locking positions, along with corresponding indexes, is provided below. The present inventors have also identified that it is for this reason that most tiller systems are lockable only at the full tilt or trailer position, or in some cases at a single additional mid-position lock.

Figure 1:
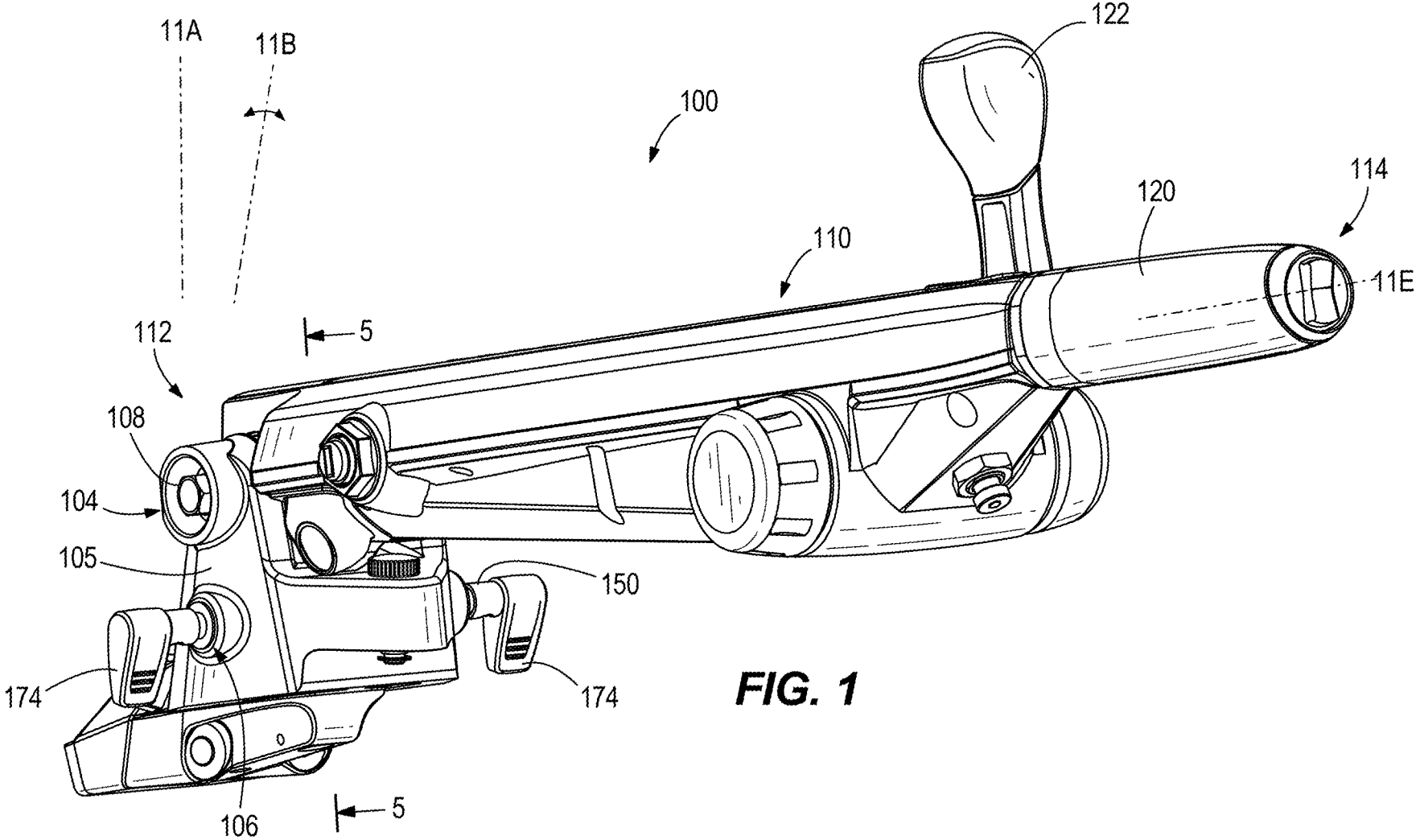
FIG. 1 depicts a perspective view of a tiller tilt and automatic release system according to the present disclosure.

FIG. 1 depicts an exemplary embodiment of a tiller system 100 according to the present disclosure. The tiller system 100 includes a tiller arm 110 that has a pivot end 112 and an opposite handle end 114. A handle 120 is positioned at the handle end 114 of the tiller arm 110, which is grasped by the operator during operation of the marine vessel. A mounting structure 105 is connected to a steering arm of a propulsion device or rudder (not shown) in the customary manner known in the art. The tiller arm 110 is pivotably connected at the pivot end 112 to a mounting structure 105 by a tilt axle 108. Specifically, the tilt axle 108 extends through a tilt axle opening 115 (FIG. 2) within the tiller arm 110 and is received in a tilt axle opening 104 within the mounting structure 105. In this manner, the tiller arm 110 pivots about a tilt axis TA (FIG. 2) formed by the tilt axle 108 between an up position 11A and a down position 11E. Intermediate positions are also defined between the up position 11A and the down position 11E, such as intermediate position 11B as shown. It should be recognized that the up position 11A need not be completely vertical (either closer or farther from the down position 11E), and likewise the down position 11E need not be completely horizontal (i.e., 5 degrees above horizontal).

FIG. 1 further show portions of a tilt lock system 130 (see also FIGS. 3-4) to be discussed below for locking the tiller arm 110 between the up position 11A and the down position 11E. In particular, FIG. 1 shows a tilt lock shaft 150 that is rotatable via a tilt lock knob 174 to activate and deactivate the tilt lock system 130. The tilt lock shaft 150 extends through a tilt lock shaft opening 106 in the mounting structure 105, which is discussed further below.

Figure 2:
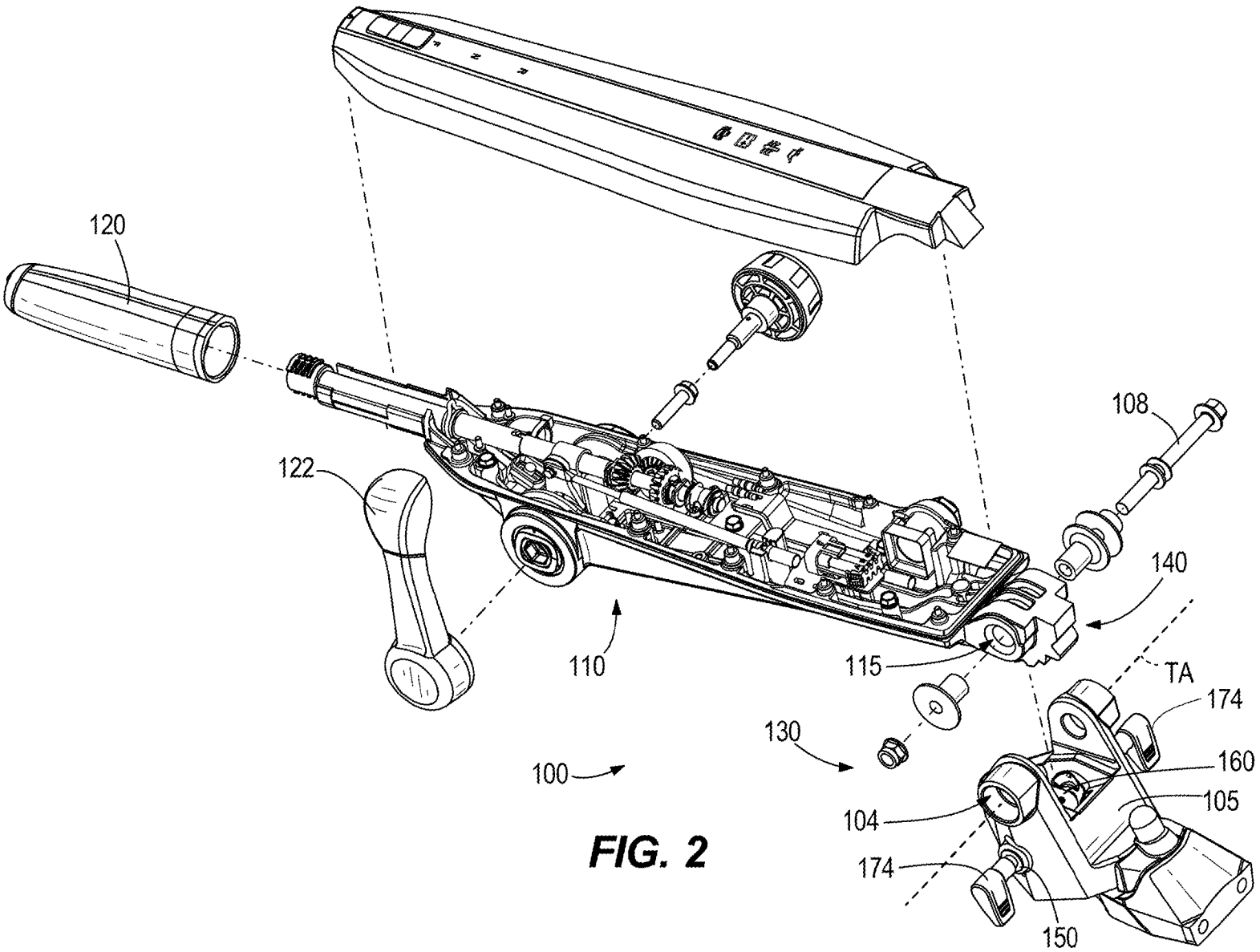
FIG. 2 is an exploded perspective view of the opposite side of the system from FIG. 1.
Figure 3:
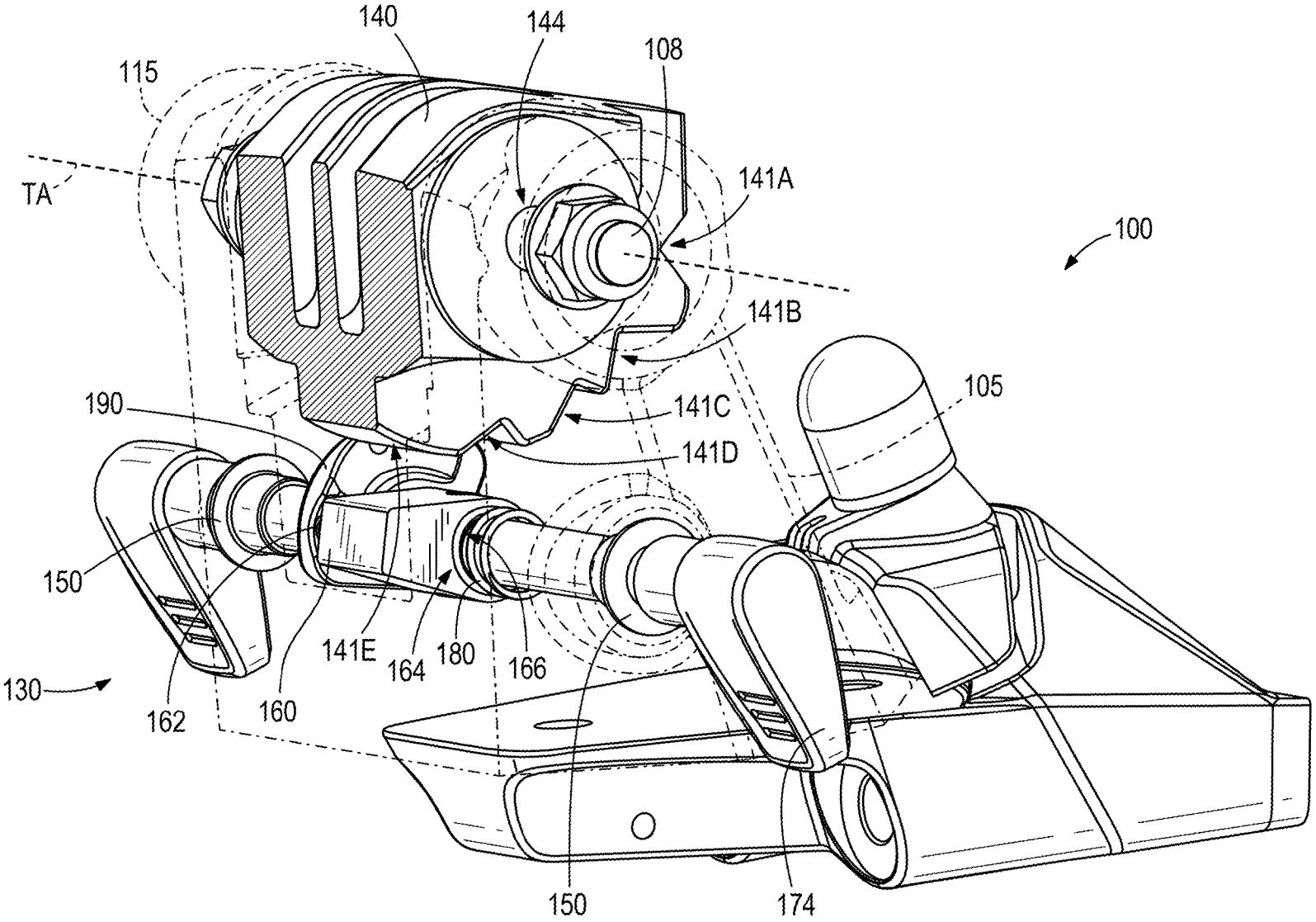
FIG. 3 is a close up front view of the system shown in FIG. 2 shown with the tiller arm removed.
Figure 4:
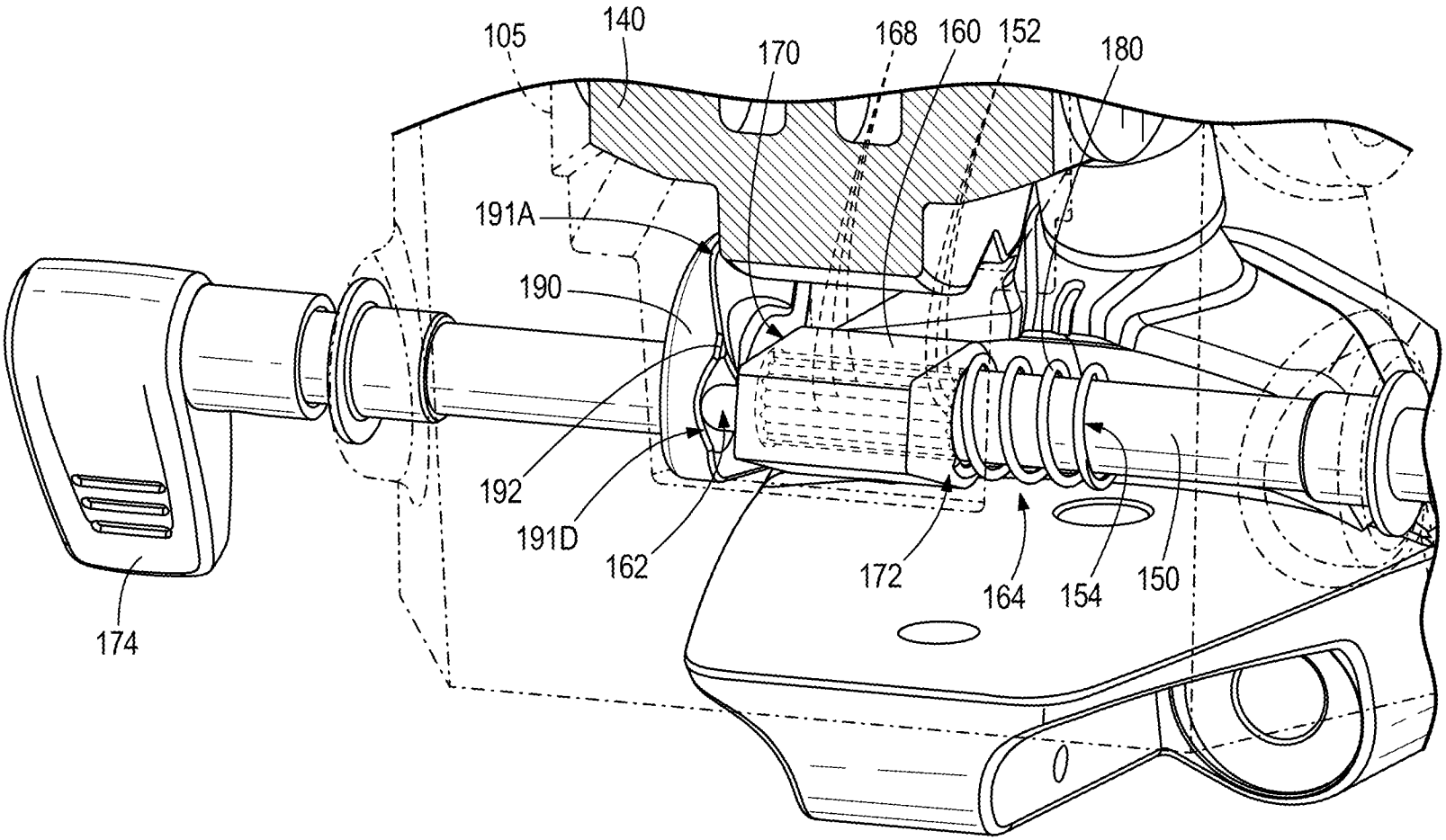
FIG. 4 is a close up front view of an alternate embodiment similar to that shown in FIG. 3.

FIG. 2 is an exploded view of the tiller system 100 of FIG. 1, which also shows a tilt lock system 130 according to the present disclosure. The tilt lock system 130 includes a first lock portion 140 that is coupled to the tiller arm 110 and a second lock portion 160 that remains with the mounting structure 105. FIGS. 3-4 show close-up views of the tilt lock system 130 of FIG. 2, presently depicting the first lock portion 140 and the second lock portion 160 in a deactivated or non-engaged state. The first lock portion 140 is fixed relative to the tiller arm 110. The same tilt axle 108 that pivotably couples the tiller arm 110 to the mounting structure 105 also extends through a tilt axle opening 144 within the first lock portion 140. In this manner, the first lock portion 140 pivots with the tiller arm 110 about the tilt axis TA. However, it should be recognized that the present disclosure also anticipates embodiments in which the first lock portion 140 remains with the mounting structure 105 and the second lock portion 160 pivots with the tiller arm 110.

Figure 9:
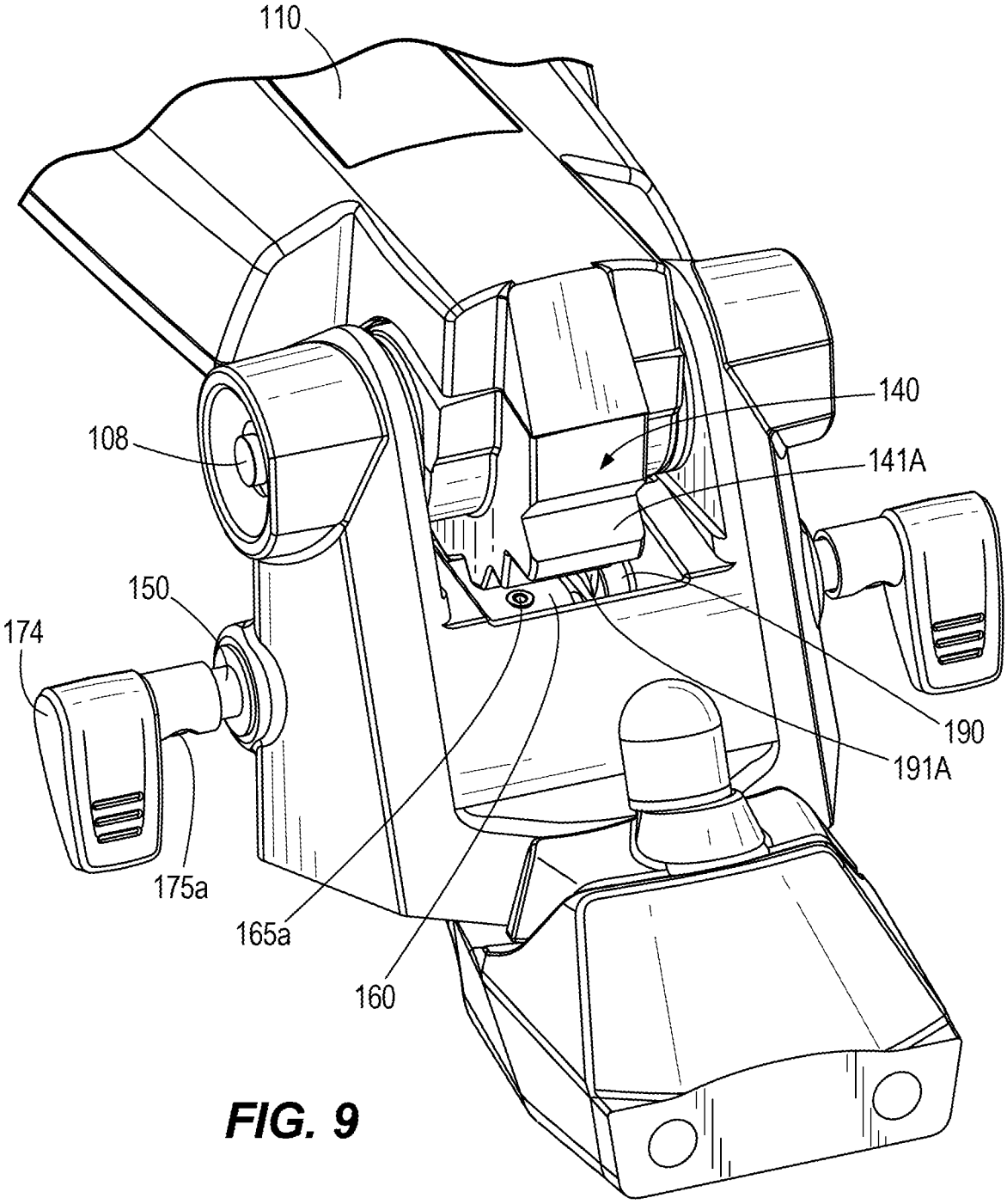
FIG. 9 is a close up rear perspective view of the system shown in FIG. 2.

As shown in FIGS. 3-4, the second lock portion 160 has an opening 166 (also shown in FIG. 11) for receiving the tilt lock shaft 150. The tilt lock shaft 150 is rotatable through operation of either one of the tilt lock knobs 174, which are coupled to opposite sides of the tilt lock shaft 150 to provide for ambidextrous use of the tiller system 100 in operation. In the embodiment shown in FIG. 4, the second lock portion 160 is coupled to the tilt lock shaft 150 via a spline joint formed by teeth 168 within the second lock portion 160 being received within grooves 152 defined within the tilt lock shaft 150. However, other mechanisms for coupling the second lock portion 160 and the tilt lock shaft 150 are also known in the art, such as through integral formation, subsequent coupling using set pins 175*a* received within openings 165*a* in the second lock portion 160 and tilt lock shaft 150 (see FIGS. 9-11), or welding, for example.

FIGS. 3-4 show the second lock portion 160 being rotatable via the tilt lock shaft 150 into and out of engagement with the first lock portion 140. More specifically, the second lock portion 160 is engageable with a number of indexes within the first lock portion 140, which correspond to the different positions for locking the tiller arm 110 discussed above. Additional views of the tilt lock system 130 are also provided in FIGS. 9-11 and discussed further below.

Figure 5:
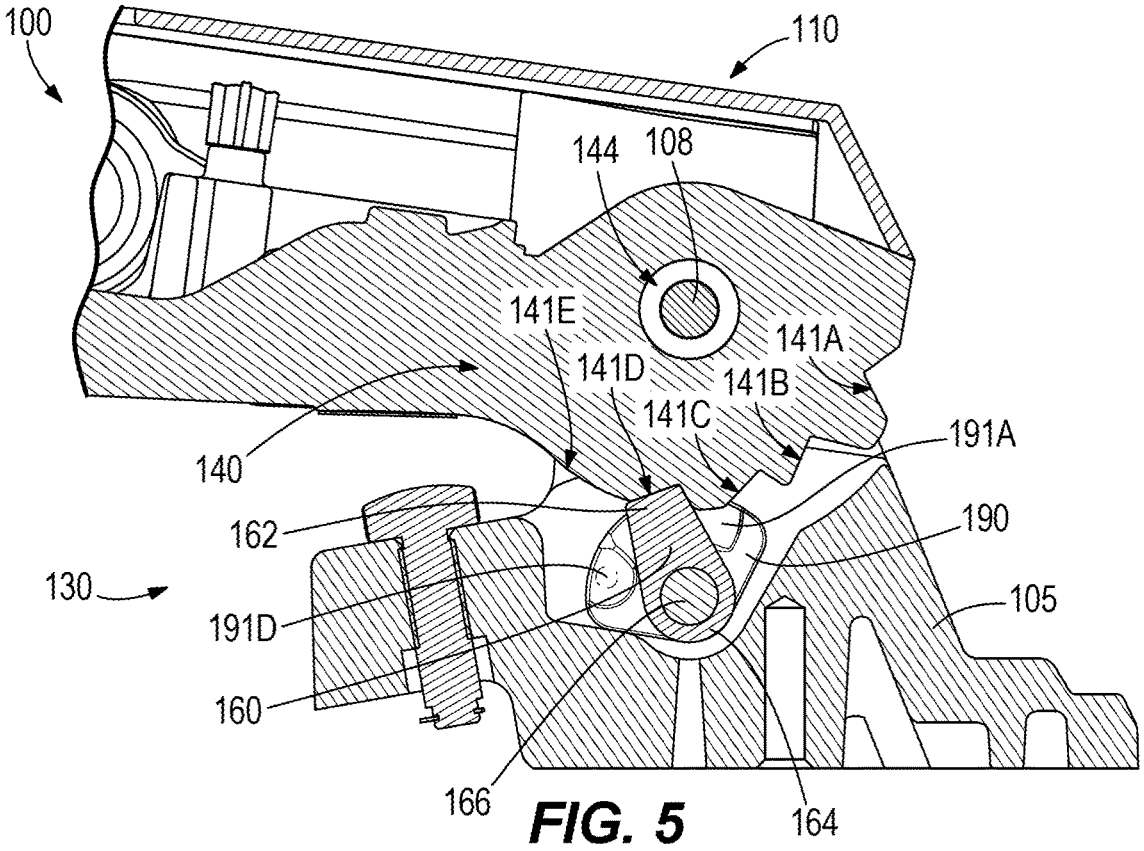
FIGS. 5-7 are sectional side views taken along the line 5-5 taken in FIG. 1 depicting progressive upward rotation and locking of the tiller arm.
Figure 6:
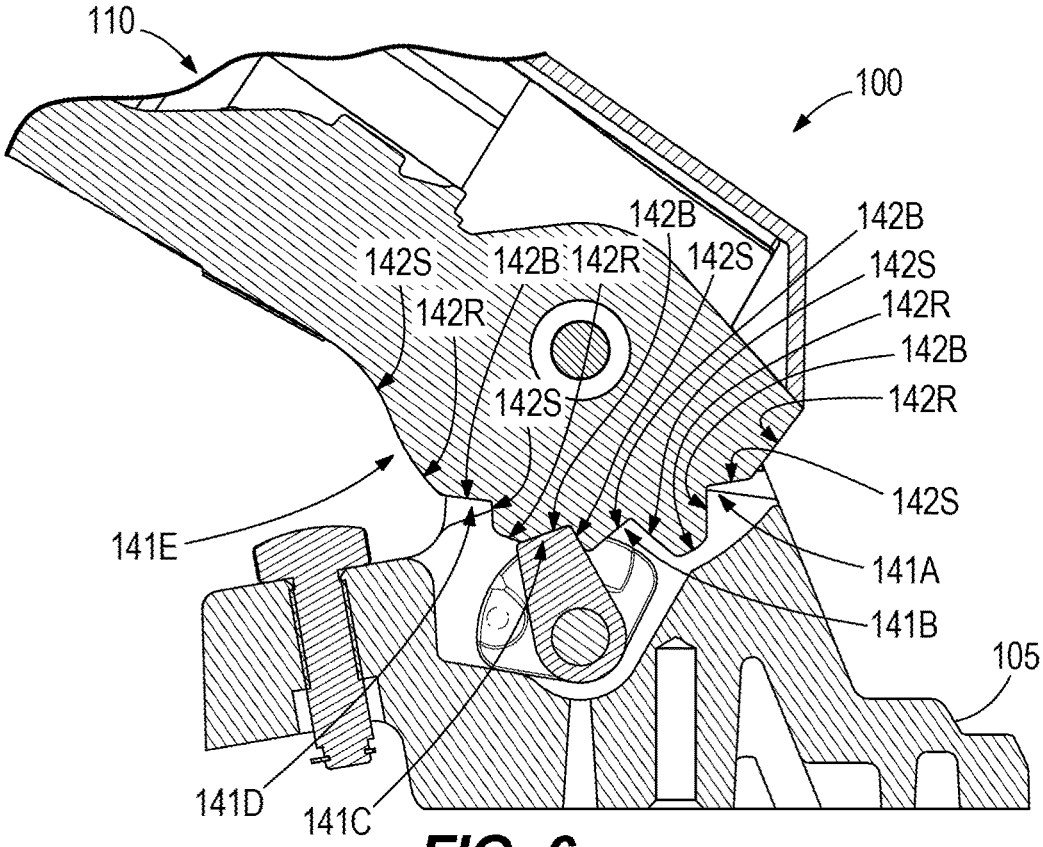
Figure 7:
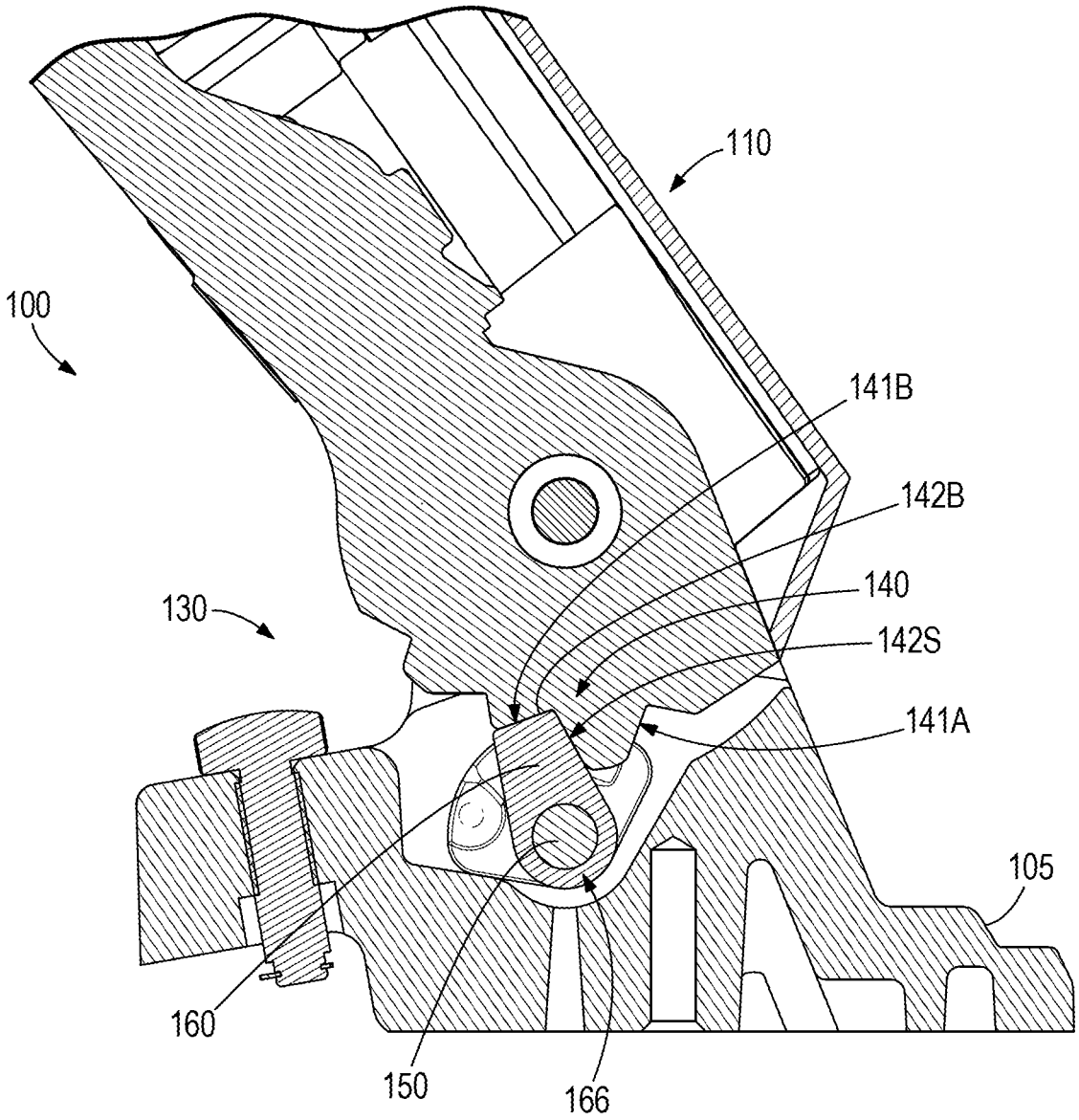
Figure 8:
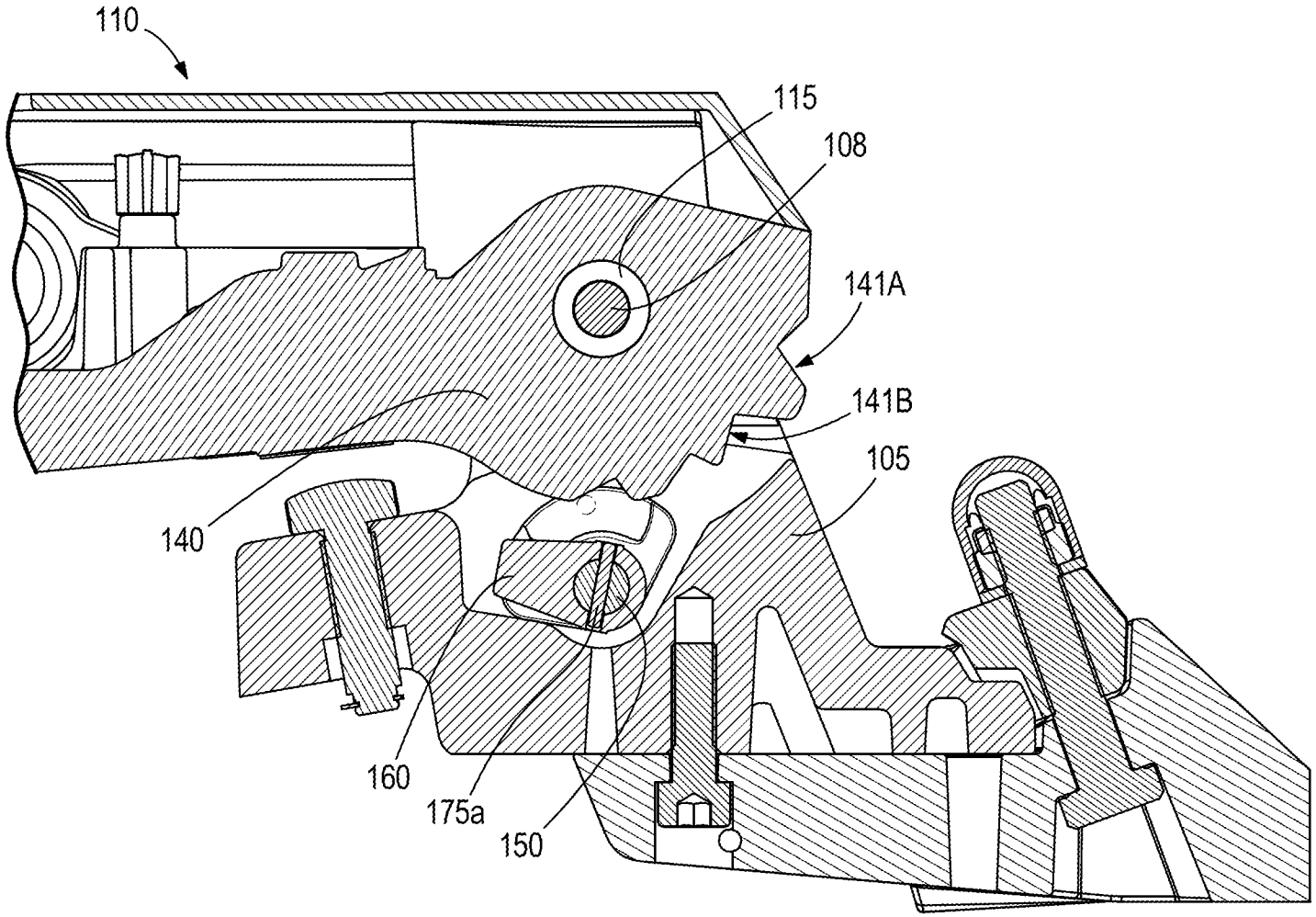
FIG. 8 depicts a side view similar to that shown in FIG. 5 with the tiller arm unlocked.

As shown in FIGS. 5-7, the first lock portion 140 includes an up index 141A and a first intermediate index 141B, as well as a second intermediate index 141C and a third intermediate index 141D. However, any number of indexes may be incorporated into the first lock portion 140, providing any number of desired tilt angles to lock the tiller arm 110. In practice, the tiller arm 110 is rotated upwardly towards the up position 11A (see FIG. 1) until the second lock portion 160 engages with an index within the first lock portion 140 to lock the tiller arm 110 at that desired tilt angle. Once locked in a given index, the tiller arm 110 is prevented from rotating downwardly until the tilt lock system 130 is deactivated (shown in FIG. 8), but may in certain embodiments continue to rotate upwardly. However, certain indexes of certain embodiments are alternatively provided as non-locking positions, such as the down index 141E shown in FIGS. 5-7. When the second lock portion 160 engages the first lock portion 140 in a non-locking position, the tiller arm 110 is not prevented from rotating further downwardly.

FIGS. 5-7 depict each of the indexes (shown here as 141A-141E) within the first lock portion 140 to be defined by one or more surfaces. These surfaces include a bottom surface 142B, a side surface 142S, and/or a ramp surface 142R. As shown, the surfaces of the first lock portion 140 that form these indexes, along with the spring loading of the second lock portion 160 to be discussed below, allow the tiller arm 110 to be freely tilted upwardly toward the up position in a ratcheting manner. Specifically, the second lock portion 160 rides or follows along the surfaces of the first lock portion 140 until automatically engaging with the next index of the first lock portion 140. The presently disclosed tilt lock system 130 does not require manual engagement and disengagement of the second lock portion 160 between positions as the tiller arm 110 is pivoted upwardly. Additional details regarding the mechanism for this automatic engagement are discussed further below.

Returning to FIGS. 4 and 11, the second lock portion 160 engages with a second lock portion retainer 190 to activate or deactivate the tilt lock system 130. The second lock portion 160 is rotatable relative to the second lock portion retainer 190, which is fixed relative to the mounting structure 105. A tilt lock shaft opening 196 (FIG. 11) is provided through the second lock portion retainer 190, which allows the tilt lock shaft 150 to extend therethrough. In this manner, the second lock portion 160 is rotatable relative to the second lock portion retainer 190 by rotation of the tilt lock shaft 150 in the manner previously described.

Figure 11:
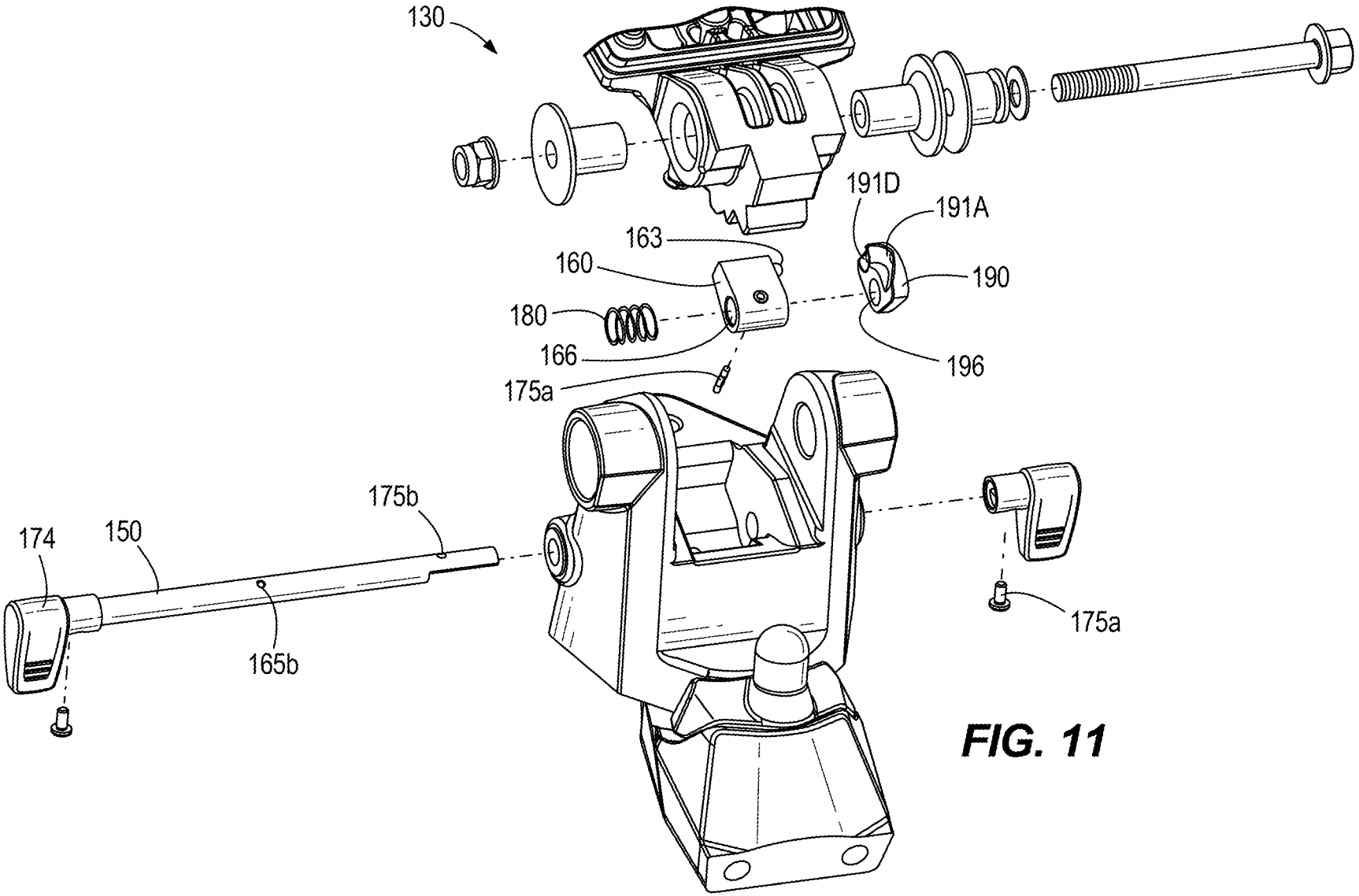

As best seen in FIGS. 4 and 11, the second lock portion retainer 190 has two depressions, an activation index 191A and a deactivation index 191D, each configured to retain the second lock portion 160 therein. When the second lock portion 160 is retained within the deactivation index 191D, the tilt lock system 130 is in the deactivated state. Specifically, the second lock portion retainer 190 prevents the second lock portion 160 from engaging with the first lock portion 140, regardless of the tilt angle of the tiller arm 110. In contrast, when the second lock portion 160 is retained within the activation index 191A, the second lock portion 160 is allowed to engage the first lock portion 140. A ramp feature 192 (FIG. 4) is provided on the second lock portion retainer 190 and separates the activation index 191A and the deactivation index 191D. In this manner, the second lock portion 160 is able to ride or slide along the ramp feature 192 to transition between the activation index 191A and the deactivation index 191D. Therefore, detent features are provided as the activation index 191A and deactivation index 191D to retain the second lock portion 160 in that respective position.

Figure 10:
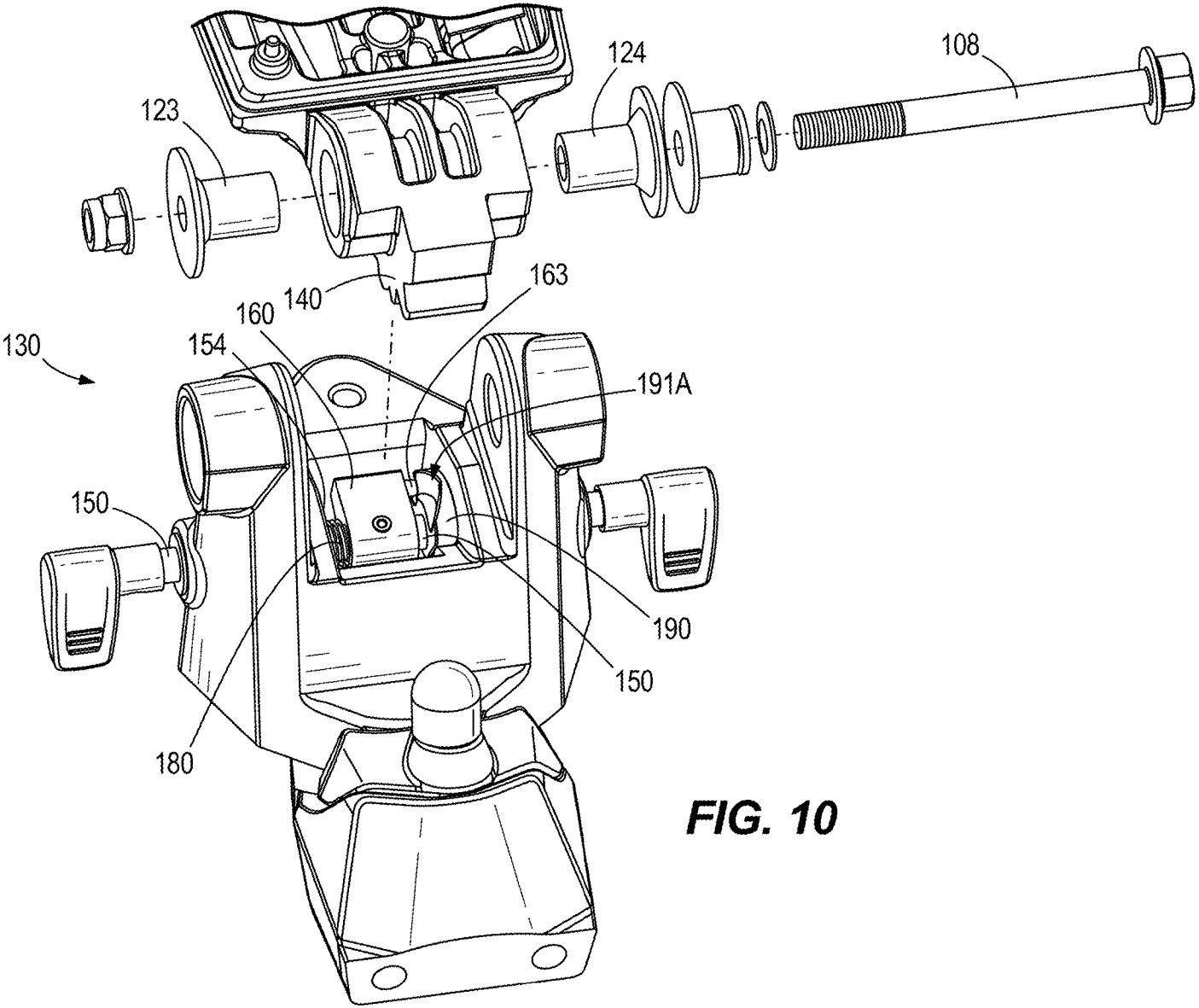
FIGS. 10-11 are further exploded views of the system shown in FIG. 9.

As shown in FIGS. 3-4, a tilt lock bias device, shown here as a spring 180, is coaxially located about the tilt lock shaft 150. Other forms of biasing devices are also known in the art, including springs providing a tensile force, for example. A first end of the spring 180 engages with or abuts against an abutment end 164 of the second lock portion 160. An opposite second end of the spring 180 engages with or abuts against a bias anchoring feature 154. In certain embodiments in which the second lock portion 160 is axially slideable via the teeth 168 within grooves 152 in the tilt lock shaft 150, this bias anchoring feature 154 is a hole, tab, or another fixation device (i.e. a screw) that fixes the spring 180 to the tilt lock shaft 150 (not shown). In other embodiments whereby the second lock portion 160 is fixed (i.e. non-slideable) relative to the tilt lock shaft 150, the tilt lock shaft 150 is axially slideable. In this case, the bias anchoring feature 154 is a hole, tab, or other fixation device (i.e. a screw) that is fixed relative to the mounting structure 105, or a portion of the mounting structure 105 itself (as shown in FIG. 10).

The spring 180 biases the second lock portion 160 into engagement with the second lock portion retainer 190 such that the second lock portion 160 is retained within either activation index 191A or deactivation index 191D. In the embodiment shown, the spring 180 provides a bias force on a bias side 172 of the second lock portion 160, which is opposite of a retainer side 170 of the second lock portion 160 that engages the second lock portion retainer 190. Likewise, the bias anchoring feature 154 (see FIG. 10) is shown as a seat or surface on the mounting structure 105.

FIGS. 5-7 depict the tiller arm 110 locked in three different positions relative to the mounting structure 105. In particular, FIG. 5 depicts the tilt lock system 130 oriented such that an engagement end 162 of the second lock portion 160 engages the first lock portion 140 within a third intermediate index 141D. Similarly, FIG. 6 depicts the second lock portion 160 engaged with a second intermediate index 141C, and FIG. 7 depicts the second lock portion 160 engaged with a first intermediate index 141B. In each case, the second lock portion 160 is retained within the activation index 191A of the second lock portion retainer 190. As previously described, the second lock portion 160 is retained within the second lock portion retainer 190 by virtue of the ramp feature 192 of the second lock portion retainer 190.

Additionally, the spring 180 biases the second lock portion 160 into engagement with the second lock portion retainer 190, preventing the second lock portion 160 from climbing the ramp feature 192 to transition to the deactivation index 191D. In certain embodiments (see FIGS. 3-4) the second lock portion 160 has an engagement pin or follower 163 that engages with the second lock portion retainer 190. In such an embodiment, the engagement pin or follower 163 is the portion of the second lock portion 160 that engages the second lock portion retainer 190 and becomes retained in the activation index 191A or deactivation index 191D.

As shown in FIG. 6, each of the indexes within the first lock portion 140 is defined by one or more surfaces. For example, the down index 141E is defined as both a side surface 142S and a ramp surface 142R. In contrast, the third intermediate index 141D is primarily defined by a bottom surface 142B, a side surface 142S, and a ramp surface 142R between the third intermediate index 141D and the second intermediate index 141C. In certain embodiments, the ramp surface 142R is shaped to provide a smooth transition between adjacent indexes when the tiller arm 110 is rotated in the upward direction (such as the transition from down index 141E to third intermediate index 141D in FIG. 5).

As previously described, the tilt lock system 130 is configured such that the second lock portion 160 automatically engages with the first lock portion 140 at certain indexes, but also permits the tiller arm 110 to continue rotating in the upward direction. Specifically, the tilt lock system 130 allows the tiller arm 110 to rotate upwardly without first deactivating the second lock portion 160. The first lock portion 140 and the second lock portion 160 automatically engage with each other at each of the defined indexes along the way. However, it should be noted that in this embodiment the tiller arm 110 cannot be rotated downwardly unless the second lock portion 160 is in the deactivated position or is otherwise disengaged from the first lock portion 140 (see FIG. 8).

Figure 12:
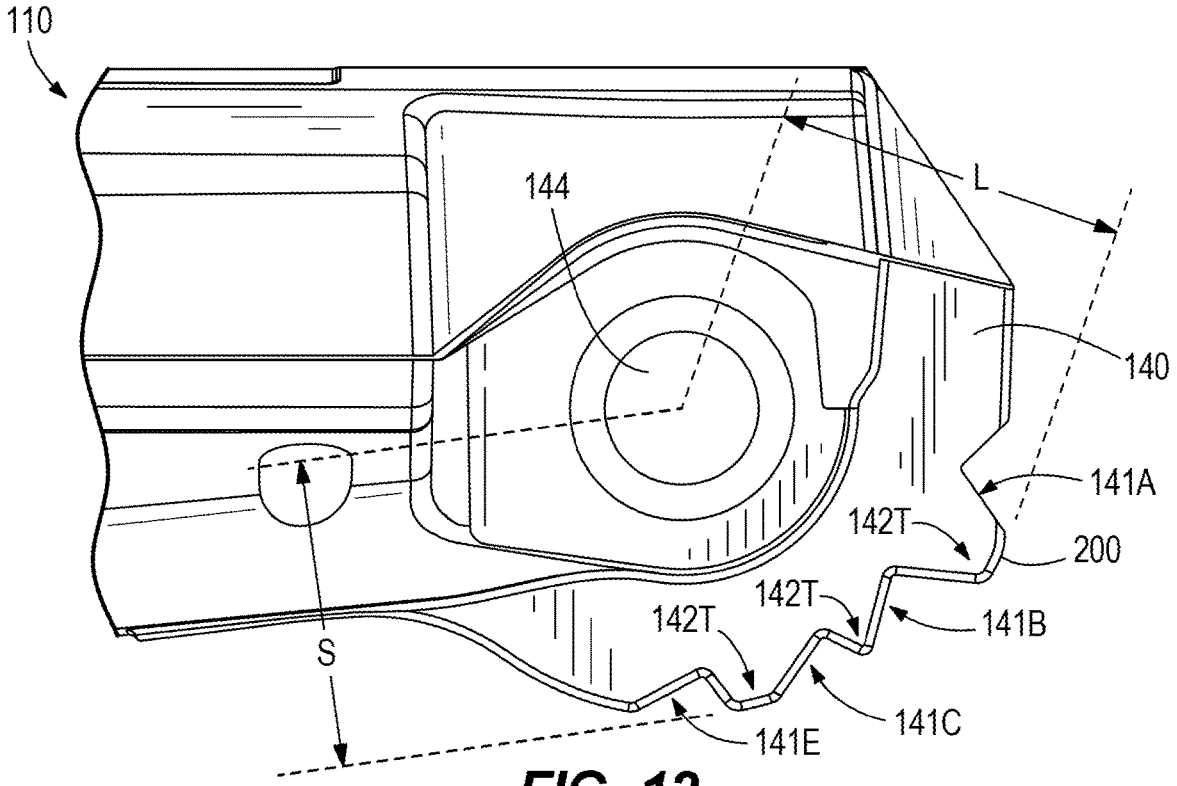
FIGS. 12-13 are close up side and rear perspective views of a portion of a tiller arm similar to that shown in FIG. 2.
Figure 13:
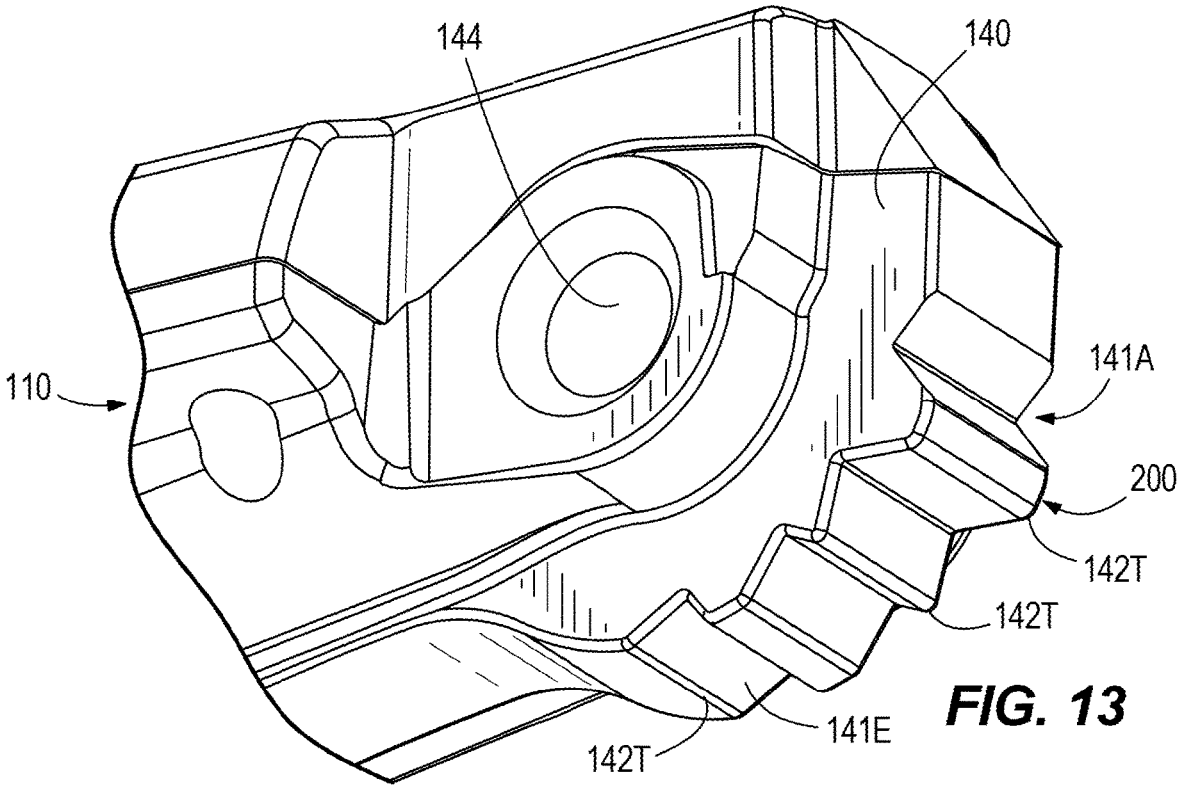

FIGS. 12-13 depict exemplary configurations for automatically disengaging the tilt lock system 130 under certain conditions. Specifically, certain embodiments are configured to disengage the tilt lock system 130 without requiring the operator to disengage the second lock portion 160 from the first lock portion 140 via the tilt lock knobs 174. FIGS. 12-13 depict an embodiment of an unlock feature 200 that automatically transitions the second lock portion 160 from the activation index 191A to the deactivation index 191D of the second lock portion retainer 190. This automatically transitions the second lock portion 160 from the activated position to the deactivated position with respect to the first lock portion 140, deactivating the tilt lock system 130.

FIG. 12 shows a first lock portion 140 having four indexes: an up index 141A, a first intermediate index 141B, a second intermediate index 141C, and a down index 141E. In this case, the first lock portion 140 does not have a third intermediate index (141D), as was shown in FIGS. 5-7. The down index 141E is now provided as a locked position. Additionally, the up index 141A in the embodiment of FIGS. 12-13 is not an automatically locking position, due to having an unlock feature 200 within the first lock portion 140. Additional details regarding the unlock feature 200 are now provided. As best shown in FIG. 12, the first lock portion 140 includes teeth 142T, which generally correspond to structures between adjacent indexes. In contrast to the other teeth 142T shown, one tooth is larger and thus serves as the unlock feature 200. The tooth 142T of the unlock feature 200 extends a radially long distance L away from the tilt axle opening 144 of the tiller arm 110, which is greater than the short distance S of the other teeth 142T.

As the tiller arm 110 is raised, the unlock feature 200 forces the second lock portion 160 from the activation index 191A to the deactivation index 191D of the second lock portion retainer 190. This prevents the second lock portion 160 from engaging within the up index 141A of the first lock portion 140. In this regard, the operator is able to permanently disengage the tilt lock system 130 by simply moving the tiller arm 110 past the up index 141A, which is now a single-handed operation.

Figure 14:
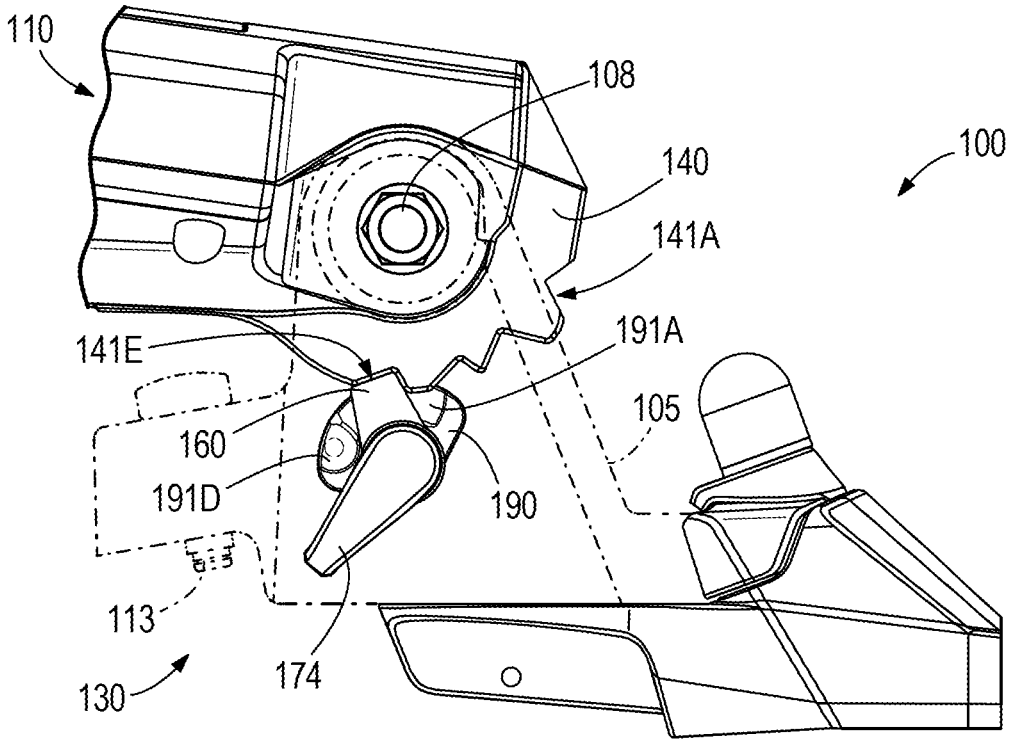
FIGS. 14-17 depict progressive side views of a system similar to that shown in FIGS. 1-2 rotating in the upward direction.
Figure 15:
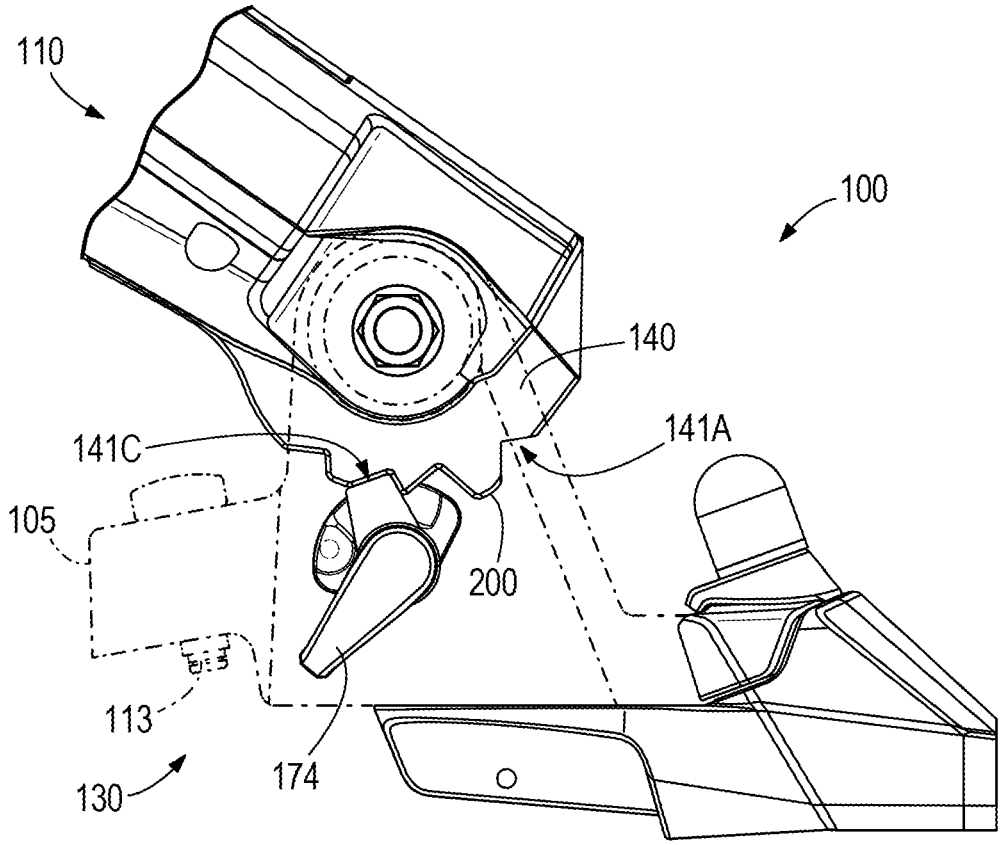
Figure 16:
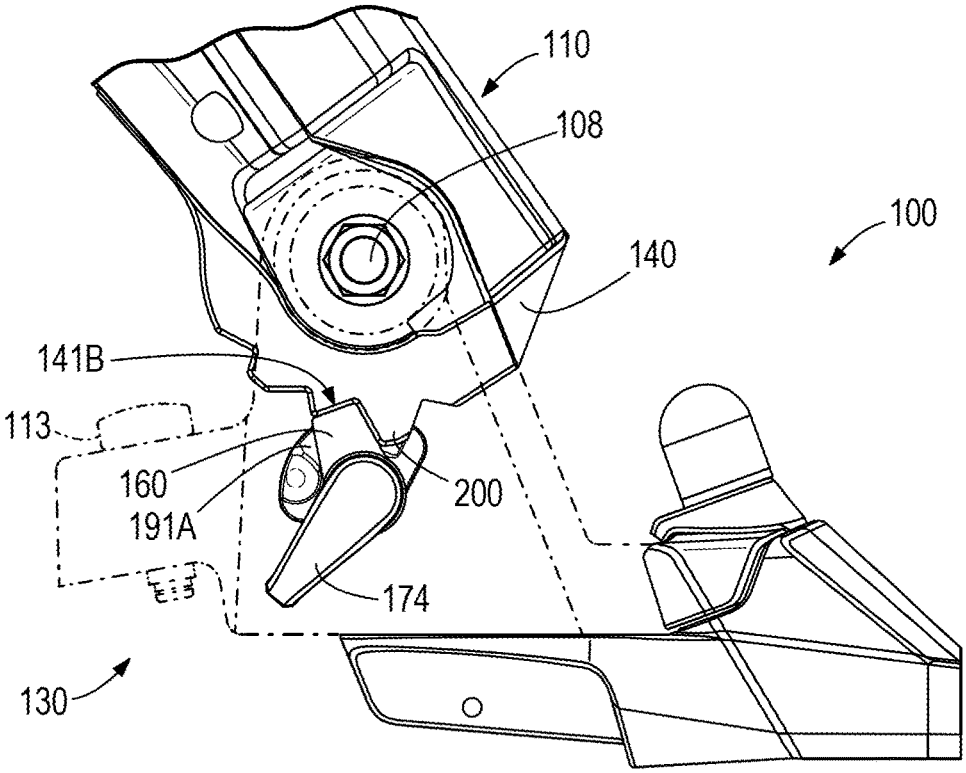

FIGS. 14-17 depict the tiller arm 110 being rotated from the down position 11E (see FIG. 1) upwardly, in sequence. Specifically, FIGS. 14-16 show the second lock portion 160 engaged with the first lock portion 140 in the down index 141E, in the second intermediate index 141C, and in the first intermediate index 141B, respectively. Some rotation of the second lock portion 160 occurs by virtue of each tooth 142T passing or ratcheting over the second lock portion 160. However, the activation index 191A of the second lock portion retainer 190 is large enough (i.e., has a long enough ramp length) to accommodate this rotation without forcing the second lock portion 160 over the ramp feature 192 (see FIG. 4) and out of the activation index 191A.

Figure 17:
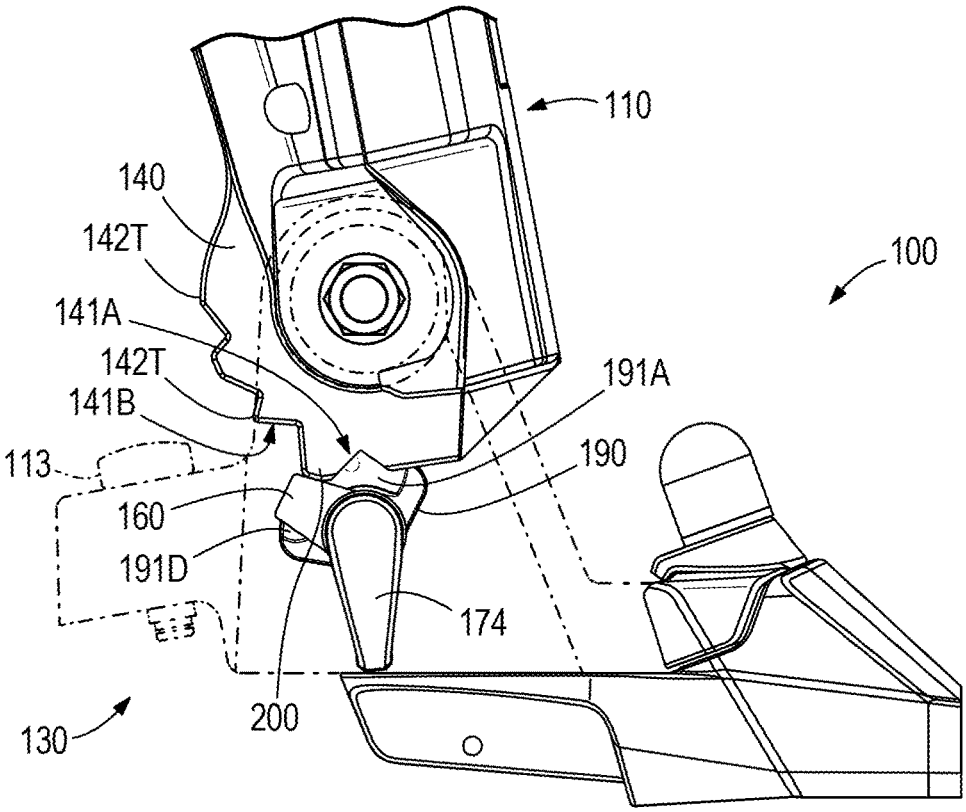

FIG. 17 depicts further upward rotation of the tiller arm 110 relative to the configuration shown in FIG. 16, beyond the first intermediate index 141B. The long distance L of the unlock feature 200 causes the second lock portion 160 to move beyond the activation index 191A of the second lock portion retainer 190 during rotation, in contrast to rotating past the other teeth 142T (see also FIG. 15). Rotating past the unlock feature 200 causes the second lock portion 160 to climb over and surpass the ramp feature 192 within the second lock portion retainer 190 (see FIG. 4) to thereby transition to the deactivation index 191D. At this point, the second lock portion 160 becomes retained within the deactivation index 191D of the second lock portion retainer 190. The second lock portion 160 is consequently retained in a deactivated index 191D and no longer able to engage with the first lock portion 140 until being rotated back to the activation index 191A by the operator via the tilt lock knobs 174.

In this manner, the tilt lock system 130 is automatically disengaged simply by virtue of rotating the tiller arm 110 upwardly to at least the position engaging the unlock feature 200, such as the position shown in FIG. 17. Further upward rotation of the tiller arm 110 past engagement between the unlock feature 200 and the second lock portion 160 does not result in automatic locking of the tiller arm 110. However, manual engagement of the second lock portion 160 with the up index 141A of the first lock portion 140 is possible by turning the tilt lock knob 174. This feature may be desirable, for example, for locking the tiller arm 110 in a trailer position for transportation.

It should be recognized that while the unlock feature 200 is shown to correspond to a tooth 142T positioned before the up index 141A (when rotating upwardly), other positions for the unlock feature 200 are also anticipated by the present disclosure. For example, the unlock feature 200 may be incorporated into a further tooth (not shown) just beyond the up index 141A such that rotation of the tiller arm 110 past the up position causes the tilt lock system 130 to automatically disengage, as previously described. This provides that the tiller arm 110 is lockable in the up position 11A (see FIG. 1), but is still automatically disengaged with further rotation of the tiller arm 110. In this example, the tilt lock system 130 can still be automatically disengaged without requiring manual manipulation of the tilt lock knob 174.

In practice, the present disclosure provides for a tilt lock system that automatically releases the tilt lock if a tiller is raised beyond a certain position, such as close to the full tilt or trailer position. While certain embodiments depict the automatic release (i.e. disengagement) to occur beyond the up position, other embodiments are anticipated in which the tilt lock system 130 is disengaged at a position before the up position is reached, as previously described. In either case, the presently disclosed systems provide easy methods for the operator to disengage the tilt lock without having to reach back and access the tilt lock knobs 174.

Moreover, the present inventors have recognized that the presently disclosed tilt lock system 130 also prevents the tiller arm 110 from locking in the full tilt position following an underwater impact (such as hitting a log), whereby locking would be detrimental to maintaining optimum steering control. In other words, if a log-strike condition causes the tiller arm 110 to rise to the up-most position, the tilt lock system 130 automatically disengages. This would allow the tiller arm 110 to be immediately positioned at a lower tiller arm 110 angle for optimum steering leverage.

Additionally, the presently disclosed systems provide for several positions for locking the tiller arm 110 between the up position and the down position. The present inventors have identified that this is particularly advantageous in that the tiller arm 110 may be positioned in accordance with the trim level of the propulsion device, including as the trim is changed when underway. For example, a first position might be desired when the propulsion device is trimmed in, another when the propulsion device is partially trimmed, and yet another when the propulsion device is fully trimmed out. Moreover, the present disclosure also allows the operator to permanently disengage the tilt lock system 130 manually, simply by shifting the second lock portion 160 to the deactivated position, wherein it is engaged with the second lock portion retainer 190 within the deactivation index 191D.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A tiller system for steering an outboard motor, the tiller system comprising:

a tiller arm rotatably coupled to the outboard motor, the tiller arm being rotatable from a down position to an up position through a plurality of lock positions therebetween; and a tilt lock system coupled between the tiller arm and the outboard motor, wherein the tilt lock system is configured to be activated and deactivated, and wherein when activated the tilt lock system prevents the tiller arm from rotating downwardly through each of the plurality of lock positions;

wherein the tiller arm is further rotatable into an unlock position, and wherein rotating the tiller arm into the unlock position automatically deactivates the tilt lock system such that the tiller arm is freely rotatable downwardly through the plurality of lock positions.

2. The tiller system according to claim 1, wherein the tilt lock system comprises a first lock portion and a second lock portion that are selectively engageable to prevent the tiller arm from rotating downwardly, wherein the second lock portion has an activated position corresponding to the tilt lock system being activated and a deactivated position corresponding to the tilt lock system being deactivated, and wherein the second lock portion is engageable with the first lock portion only when the second lock portion is in the activated position, further comprising an unlock member operatively coupled between the tiller arm and the outboard motor and configured to move the second lock portion from the activated position to the deactivated position by rotating the tiller arm.

3. The tiller system according to claim 2, wherein the first lock portion rotates with the tiller arm.

4. The tiller system according to claim 2, wherein the unlock member is configured to move the second lock portion to the deactivated position when the tiller arm is rotated upwardly past the unlock position.

5. The tiller system according to claim 2, wherein the up position is upward from the unlock position.

6. The tiller system according to claim 2, wherein the first lock portion defines a plurality of index positions each configured to receive the second lock portion to prevent downward rotation of the tiller arm therefrom.

7. The tiller system according to claim 6, wherein the first lock portion is a gear comprising a plurality of teeth that define the plurality of index positions, wherein the second lock portion is a pawl, and wherein upward rotation of the tiler arm rotates the plurality of teeth and ratchets the second lock portion between the plurality of index positions.

8. The tiller system according to claim 7, wherein one of the plurality of teeth has a radially longer length to thereby form the unlock member.

9. The tiller system according to claim 2, further comprising a lock controller cam having an activated index and a deactivated index, and further comprising a bias device that biases the second lock portion into engagement with the lock controller cam, wherein the activated index and the deactivated index correspond to the second lock portion being in the activated position and the deactivated position, respectively, and wherein the unlock member overcomes the bias device to move the second lock portion from the activated index to the deactivated index.

10. The tiller system according to claim 9, wherein the first lock portion is a gear defining a plurality of index positions and the second lock portion is a pawl engageable therein, wherein upward rotation of the tiller arm ratchets the second lock portion between the plurality of index positions, and wherein the second lock portion moves within the activated index until the unlock member moves the second lock portion to the deactivated index.

11. The tiller system according to claim 9, wherein the lock controller cam comprises a ramp separating the activated index and the deactivated index, wherein the second lock portion remains in constant engagement with the lock controller cam in the activated index, the deactivated index, and when transitioning therebetween.

12. The tiller system according to claim 9, further comprising a tilt lock shaft that rotates with the second lock member, wherein the second lock portion is also moveable to the deactivated position by manual rotation of the tilt lock shaft in an unlock direction.

13. The tiller system according to claim 12, wherein the second lock portion is moveable to the activated position by manual rotation of the tilt lock shaft in a lock direction that is opposite the unlock direction.

14. The tiller system according to claim 13, further comprising two tilt lock knobs coupled at opposite ends of the tilt lock shaft, wherein the tilt lock shaft is rotatable by rotating either of the two tilt lock knobs.

15. The tiller system according to claim 12, wherein the tilt lock shaft and the second lock portion are coupled via splines, and wherein the bias device is a spring.

16. The tiller system according to claim 12, wherein the tilt lock shaft and the tiller arm rotate in parallel.

17. The tiller system according to claim 16, wherein the tilt lock shaft is positioned below the tiller arm.

18. The tiller system according to claim 12, wherein the second lock portion is rotatable within a plane, and wherein the lock controller cam moves the second lock portion perpendicularly to the plane.

19. The tiller system according to claim 2, wherein the first lock portion and the second lock portion are further engageable to prevent rotation of the tiller arm in the upward direction.

20. A tiller system for steering an outboard motor, the tiller system comprising:

a tiller arm rotatably coupled to the outboard motor;

a first lock portion and a second lock portion operatively coupled between the tiller arm and the outboard motor and selectively engageable to prevent the tiller arm from rotating downwardly, wherein the first lock portion has a plurality of teeth and rotates with the tiller arm, wherein the plurality of teeth define a plurality of index positions each configured to receive the second lock portion to prevent downward rotation of the tiller arm therefrom, wherein the second lock portion has an activated position and a deactivated position, and wherein the second lock portion is engageable with the first lock portion only when the second lock portion is in the activated position;

an unlock member coupled to the first lock portion and configured to move the second lock portion from the activated position to the deactivated position by rotating the tiller arm;

a lock controller cam having an activated index and a deactivated index;

a bias device that biases the second lock portion into engagement with the lock controller cam, wherein the activated index and the deactivated index correspond to the second lock portion being in the activated position and the deactivated position, respectively, and wherein the unlock member overcomes the bias device to move the second lock portion from the activated index to the deactivated index; and a tilt lock shaft that rotates with the second lock member, wherein the second lock portion is also moveable to the deactivated position by manual rotation of the tilt lock shaft in an unlock direction.

* * * * *